US008915294B2

(12) United States Patent
Mazzocco et al.

(10) Patent No.: US 8,915,294 B2
(45) Date of Patent: Dec. 23, 2014

(54) HEAT EXCHANGER END CAP

(75) Inventors: Nicholas Mazzocco, Clawson, MI (US); Jason Hendry, Milford, MI (US)

(73) Assignee: DENSO International America, Inc., Southfield, MI (US)

( * ) Notice: Subject to any disclaimer, the term of this patent is extended or adjusted under 35 U.S.C. 154(b) by 519 days.

(21) Appl. No.: 13/040,785

(22) Filed: Mar. 4, 2011

(65) Prior Publication Data

US 2012/0222850 A1 Sep. 6, 2012

(51) Int. Cl.

| | |
|---|---|
| ***F28D 1/00*** | (2006.01) |
| ***F28F 9/00*** | (2006.01) |
| ***F28F 9/02*** | (2006.01) |
| *F28D 1/053* | (2006.01) |
| *F28D 21/00* | (2006.01) |

(52) U.S. Cl.

CPC ..... *F28F 9/001* (2013.01); *F28F 9/0212* (2013.01); *F28D 1/05366* (2013.01); *F28D 2021/0084* (2013.01)

USPC ..... 165/149; 165/67; 165/175

(58) Field of Classification Search

CPC ..... F28F 9/001; F28F 9/002; F28F 9/005; F28F 9/00; F28F 9/02; F28F 9/0219; F28F 9/0224; F28F 9/0209; F28F 9/0212

USPC ..... 165/149, 67, 173, 174; 403/381, 403

See application file for complete search history.

(56) References Cited

U.S. PATENT DOCUMENTS

| | | | | |
|---|---|---|---|---|
| 3,246,691 | A * | 4/1966 | La Porle et al. | 165/151 |
| 4,936,381 | A * | 6/1990 | Alley | 165/176 |
| 5,125,454 | A * | 6/1992 | Creamer et al. | 165/173 |
| 5,236,042 | A * | 8/1993 | Kado | 165/149 |
| 5,265,672 | A * | 11/1993 | Aoki | 165/149 |
| 5,607,012 | A * | 3/1997 | Buchanan et al. | 165/173 |
| 6,012,513 | A * | 1/2000 | Iokawa et al. | 165/149 |
| 6,234,238 | B1 * | 5/2001 | Koyama et al. | 165/78 |
| 6,250,381 | B1 * | 6/2001 | Nishishita | 165/175 |
| 6,357,519 | B1 | 3/2002 | Ozaki et al. | |
| 7,059,050 | B2 * | 6/2006 | Calhoun et al. | 29/890.052 |
| 2002/0053423 | A1 * | 5/2002 | Koizumi et al. | 165/149 |
| 2003/0006029 | A1 * | 1/2003 | Kelsey | 165/175 |
| 2003/0037915 | A1 * | 2/2003 | Manaka | 165/149 |
| 2006/0113069 | A1 * | 6/2006 | Ninagawa et al. | 165/149 |

(Continued)

FOREIGN PATENT DOCUMENTS

| | | |
|---|---|---|
| JP | 2008304168 | 12/2008 |

*Primary Examiner* — Allen Flanigan
*Assistant Examiner* — Jason Thompson
(74) *Attorney, Agent, or Firm* — Harness, Dickey & Pierce, P.L.C.

(57) ABSTRACT

A heat exchanger assembly, such as a condenser, may employ a portion of a heat exchanger end tank to define a slot with a second portion of the end tank. The first and second portions define an interior volume of the end tank. A flared end of a side plate may reside within the slot and may have a straight portion having a first width, a first step portion having a second width that is wider than the first width, and a second step portion that has a third width that is wider than the second width. The flared end may have a tab that protrudes from the second step portion and that is symmetrical about a longitudinal axis of the side plate. The end tank may define a second slot where the tab resides when the flared end resides over an entire cross-sectional portion of a volume defined by end tank.

23 Claims, 4 Drawing Sheets

(56) References Cited

U.S. PATENT DOCUMENTS

2006/0124289 A1* 6/2006 Shinmura et al. ..... 165/176
2006/0144579 A1* 7/2006 Ozaki ..... 165/173
2006/0272801 A1* 12/2006 Ikawa ..... 165/149
2009/0255656 A1* 10/2009 Numasawa et al. ..... 165/173

* cited by examiner

HEAT EXCHANGER END CAP

FIELD

The present disclosure relates to heat exchangers, and more particularly, to an end cap of a heat exchanger.

BACKGROUND

This section provides background information related to the present disclosure which is not necessarily prior art. Heat exchangers have generally been satisfactory for their intended purposes; however known heat exchangers are generally not without their share of limitations. FIGS. 9-11 depict currently know configurations of condensers. FIG. 9 depicts a perspective view of a condenser end tank 10 that defines a slot 12 that perforates a wall 14 of condenser end tank 10. An end cap 16 is placed over a top end 18 of condenser end tank 10 after insertion of tab 20 of side plate 22 into slot 12 of condenser end tank 10. FIG. 10 depicts a perspective view of an assembly 24 of side plate 22, end cap 16 and condenser end tank 10. Upon brazing, any liquid and gaseous content within condenser end tank 10 becomes sealed within condenser end tank 10. FIG. 11 depicts a side view of assembly 24 and how end cap 16 resides over side plate 22 and top end 18 of condenser end tank 10. Additionally, FIG. 11 depicts how tab 20 of side plate 22 protrudes into an interior volume 26 of condenser end tank 10 such that tab 20 is a cantilever and end tip 28 of tab 20 does not contact any portion or structure of condenser end tank 10. More specifically, with regard to FIGS. 9-11, end tip 28 of tab 20 does not contact any interior surface or interior structure of condenser end tank 10.

While the structure of FIGS. 9-11 has been satisfactory for its given purpose, a need exists in the art for a structure that seals an interior volume 26 of condenser end tank 10, yet reduces part count and improves resistance to motion and vibration when condenser end tank 10 is in service in a moving vehicle.

SUMMARY

This section provides a general summary of the disclosure, and is not a comprehensive disclosure of its full scope or all of its features. A heat exchanger assembly may employ a cantilever or first portion of a heat exchanger end tank that defines part of an interior volume of the heat exchanger end tank. A second portion of the heat exchanger end tank, such as that portion under the cantilever portion, may define a slot. A flared end of the side plate may reside within the slot. The flared end of the side plate may have a straight portion having a first width, a first step portion having a second width that is wider than the straight portion, a second step portion having a third width that is wider than a second width of the first step portion. The flared end of the side plate may have a tab that protrudes in a longitudinal direction of side plate from the second step portion. The tab may be symmetrical about a longitudinal axis of the side plate.

The heat exchanger end tank may define a second slot or hole such that the tab resides in the second slot when the flared end of the side plate resides within the first slot. The flared end may cover an entire cross-sectional portion of a volume defined by the end tank. That is, the area between the edges of the side plate in the regions of the first step portion and the second step portion may cover the elliptical hole.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
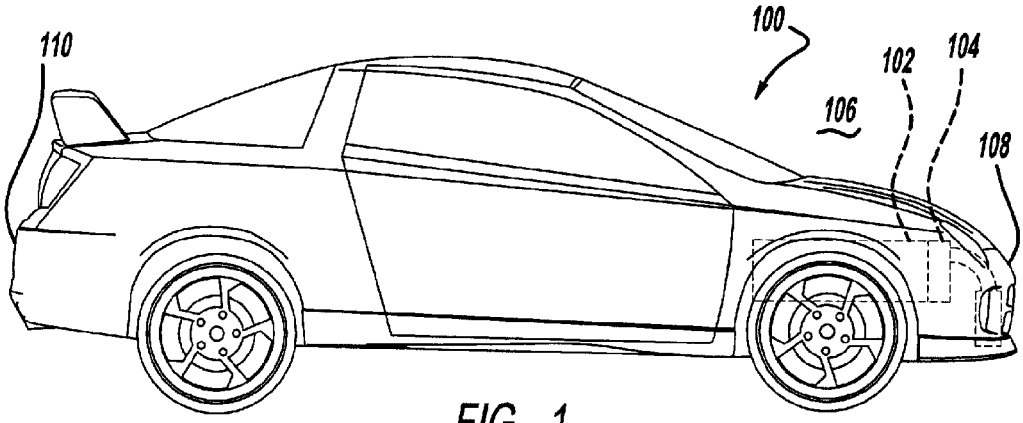
FIG. 1 is a side view of an automobile depicting a location of the teachings of the present disclosure.

Example embodiments will now be described more fully with reference to FIGS. 1-8 of the accompanying drawings. FIG. 1 depicts a vehicle 100 with an engine 102, and in front of engine 102, a heat exchanger 104, which may be a condenser and may be mounted to provide heat exchange between outside or ambient air 106 and a liquid or gas, such as xxx, flowing through channels or tubes of heat exchanger 104. Throughout this detailed description, terms such as "in front of," "behind," are relative to a front and rear of vehicle 100. Thus, when heat exchanger 104 is positioned in front of engine 102, this means that heat exchanger 104 is located closer to a front end 108 of vehicle 100. Similarly, if engine 102 is described as being located behind heat exchanger 104, this means that engine 102 is both, farther from a front end 108 of vehicle 100 and closer to a rear end 110 of vehicle 100. Heat exchanger 104, as depicted in FIG. 1, may be a condenser.

Figure 2:
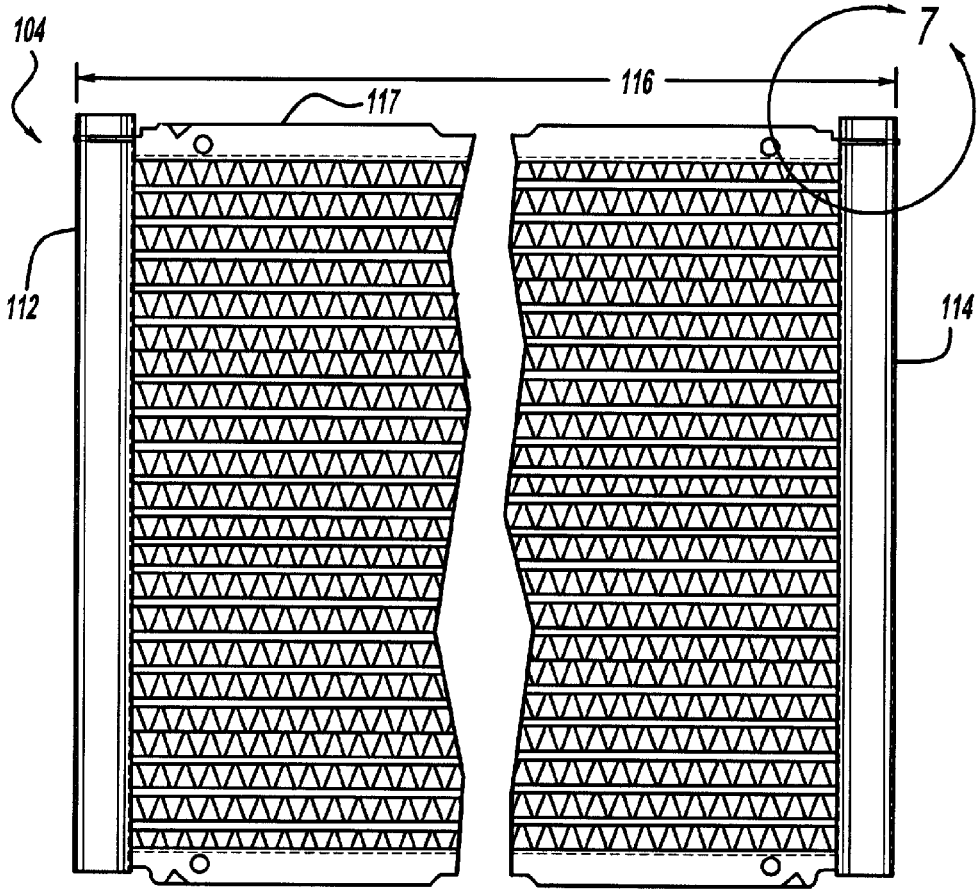
FIG. 2 is a schematic view of a vehicle engine and radiator depicting an example location of the teachings of the present disclosure.
Figure 3:
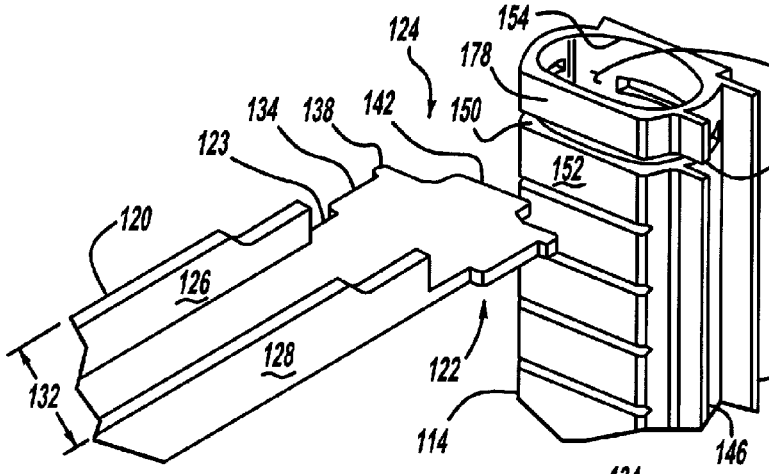
FIG. 3 is a rear view of a radiator depicting an example location of the teachings of the present disclosure.

FIG. 2 is a front view of heat exchanger 104, which may have a left end tank 112 and a right end tank 114. A top end 117 of heat exchanger 104 may traverse an entire width 116 of heat exchanger 104. FIG. 3 depicts a portion of top end 117 of heat exchanger 104, and more specifically an assembly or coupling location of an end tank and a side plate. Such assembly or coupling location may be known as a heat exchanger assembly 118, which may include multiple and various parts related to a heat exchanger. Continuing, FIG. 3 depicts side plate 120 with a flat protrusion 122 having a flared end 124. Side plate 120 may have side rail 126 and side rail 128 that may be bent portions and form a ninety degree angle with flat protrusion 122 or an angle that is approximately ninety degrees. With reference including FIG. 5, flared end 124 of flat protrusion 122 may have various widths, and such various widths may be relative to a base width 130 of flat protrusion 122. Base width 130, which may include a non-flared portion 123 of flat protrusion 122, may be the same as a width 132 of side plate 120 that traverses or spans between each left end tank 112 and right end tank 114. Thus, base width 130 may be the same as width 132 yet not include side rails 126, 128 because it is part of flat protrusion 122 and side rails 126, 128 are not flat. Continuing with flared end 124 of flat protrusion 122, first step portion 134 may have a width 136 that is wider than width 132 of side plate 120 and base width 130 of non-flared portion 123. Moreover, slot 150, which may reside in a wall of end tank 114 may terminate at rib surface 160 of second strengthening rib 148. Thus, wall portions 174 of interior wall surface 176 that reside on either side of through slot 164 and between through slot 164 and slot 150 has no slot formed or cut into it. Thus, wall portions 174 remain smooth with no slot, cut or grooves.

Figure 5:
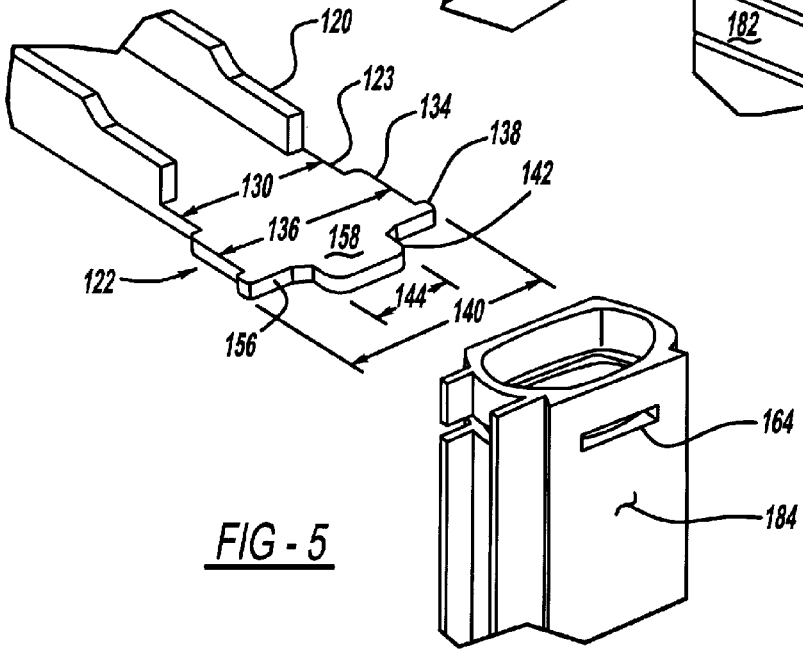
FIG. 5 is a side view of an embodiment of the teachings of the present disclosure.

Continuing with FIG. 5, a second step portion 138 may have a width 140 that may be wider than width 136 of first step portion 134. Second step portion 138 may be the widest portion of flat protrusion 122. An end tab 142 may have a width 144 that is less than each of base width 130, width 136 of first step portion 134 and width 140 of second step portion 138.

Referring again to FIG. 3, end tank may be on one of left end tank 112 or right end tank 114. For discussion purposes, end tank will be a right end tank 114. Right end tank 114 may have a first strengthening rib 146 and a second strengthening rib 148 that each protrude an equal distance from an outside surface of right end tank 114 along an entire length of end tank 114 or a partial length of end tank 114. Second strengthening rib 148 may protrude uninterrupted with no slots or other aberrations in geometry along a length of end tank 114. However, strengthening rib 146 may have a slot 150 cut or formed into it. Slot 150 may originate or begin at a face 152 and proceed through a cross section of right end tank 114. Slot 150 may be cut or formed parallel to flat surface or face 152 of right end tank 114. Flat surface or face 152 of right end tank 114 may be the surface that initially receives end tab 142 during insertion of end tab 142 into slot 150. With slot 150 formed in wall bounding hole 154, and slot 170 through first strengthening rib 146, a cantilever portion 178 is formed with a portion of tank end. Wall portions 174 support cantilever portion 178.

Figure 4:
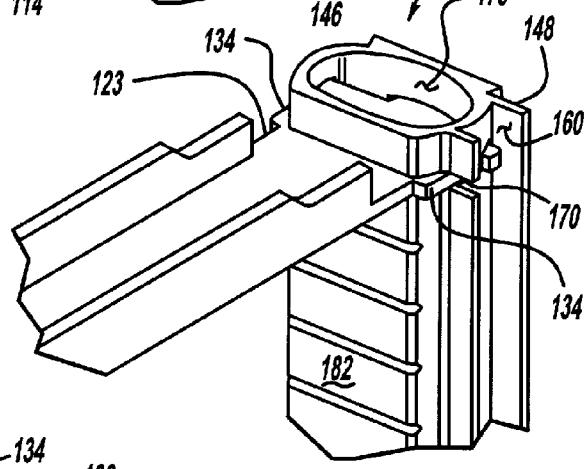
FIG. 4 is a perspective view of an embodiment of the teachings of the present disclosure.
Figure 6:
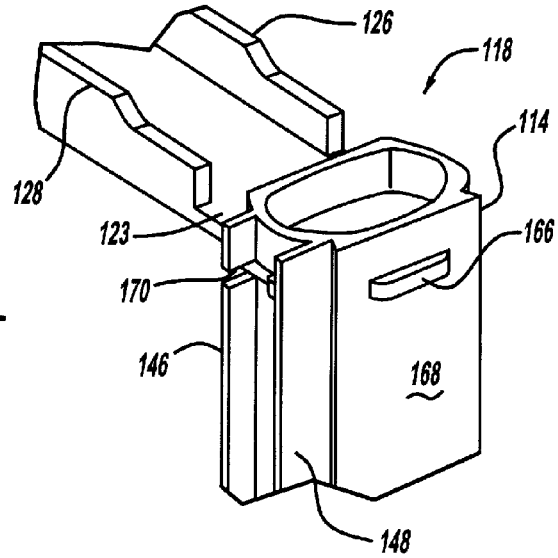
FIG. 6 is a perspective view of an embodiment of the teachings of the present disclosure.

With reference also including FIG. 4 and FIG. 6, a complete insertion of end tab 142 into slot 150 may include an entirety of flat protrusion 122 passing into slot such that a substantial portion of flat protrusion 122 resides within slot 150 when flared end 124 is in its installed position within slot 150. During an insertion, flared end 124 is directed into slot 150 at face 152. Because second step portion 138 has a wider width 140 than a major axis 162 of hole 154, which may be oval or elliptical, second step portion 138 passes through slot 150 that is in first strengthening rib 146 and a leading surface 156.

Figure 8:
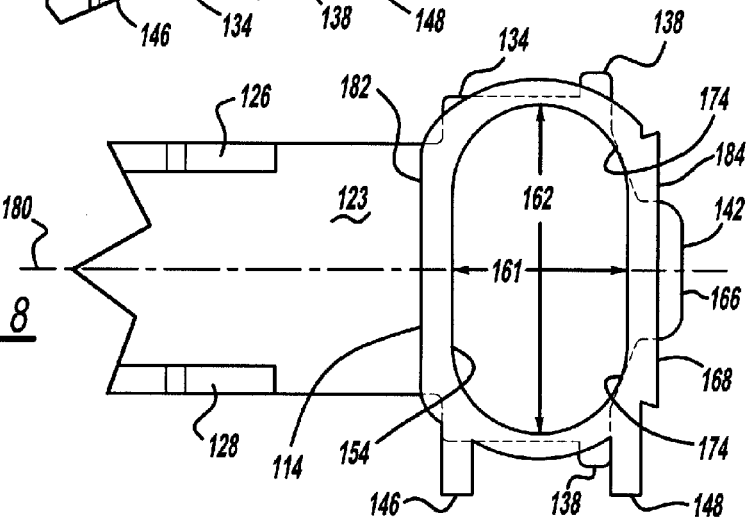
FIG. 8 is a perspective view of an embodiment of the teachings of the present disclosure.
Figure 9:
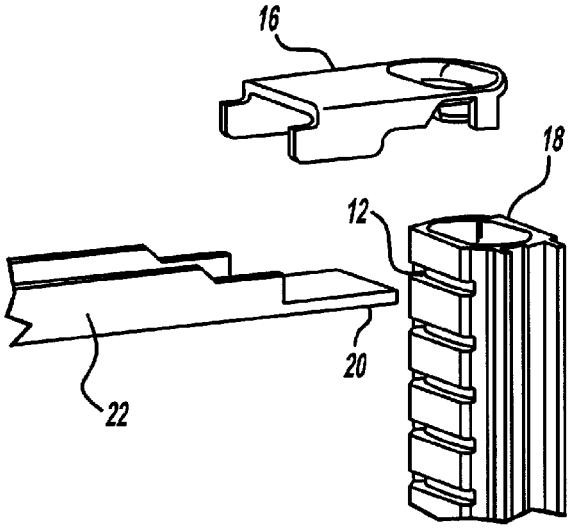
FIG - 9 Prior Art
FIG. 9 is a perspective view of components of an embodiment known to be prior art.
Figure 10:
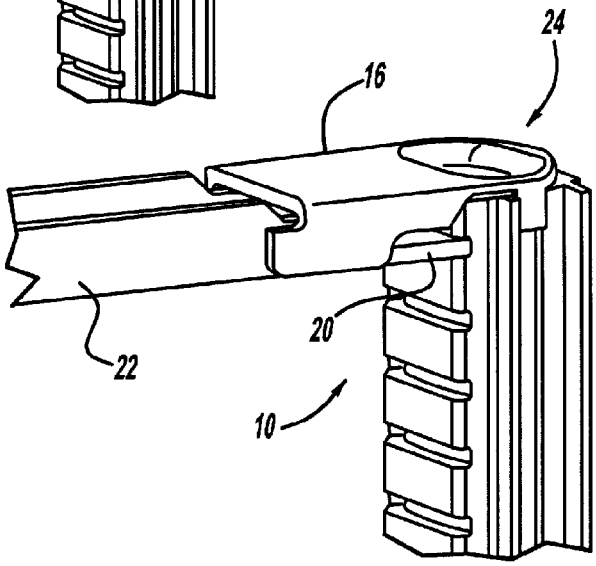
FIG - 10 Prior Art
FIG. 10 is a perspective view of an assembly of the prior art components depicted in FIG. 9.
Figure 11:
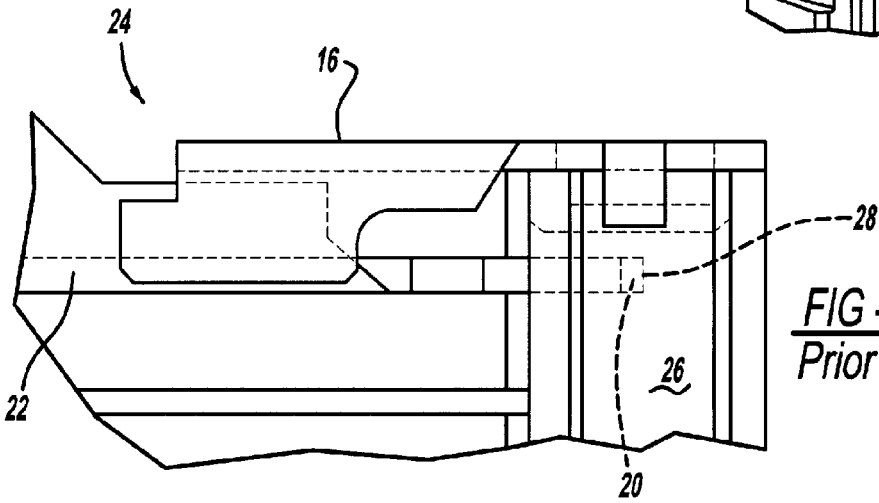
FIG - 11 Prior Art
FIG. 11 is a side view of an assembly of the prior art components depicted in FIGS. 9 and 10.

When flared end 124 is in its installed position within slot 150, leading surface 156, which may be perpendicular to surface 158 or flat protrusion 122, may abut or contact rib surface 160, which may be perpendicular to an insertion direction of flat protrusion 122 and face toward first strengthening rib 146. When leading surface 156 abuts or contacts rib surface 160, part of end tab 142 completely passes through a through slot 164 or hole such that an end surface 166 of end tab 142 resides outside of hole 154 and outside of, or in other words beyond, an outside surface 168 of end tank 114. Additionally, as depicted in FIG. 8, when insertion is complete, first step portion 134 resides within slot 170 of first strengthening rib 146 that coincides with, and may be cut or formed at the same time as, slot 150 in surface 152 and right end tank 114. FIG. 8 also depicts elliptical hole 154 being completely covered by flat protrusion 122, and more specifically flared end 124, and even more specifically by a combination of first step portion 134 and second step portion 138. Thus, upon brazing about a perimeter or periphery of elliptical hole 154, interior volume 174 within end tank 114 may contain liquid and gaseous material in a leak-proof fashion. That is, elliptical hole 154, slot 150, slot 170 and hole 164 become leak proof after brazing. In accomplishing a leak-proof state, flat protrusion 122 may contact surfaces bounding slot 150, slot 170, hole 154 and hole 164 yet permit a forced insertion in a type of interference fit.

Figure 7:
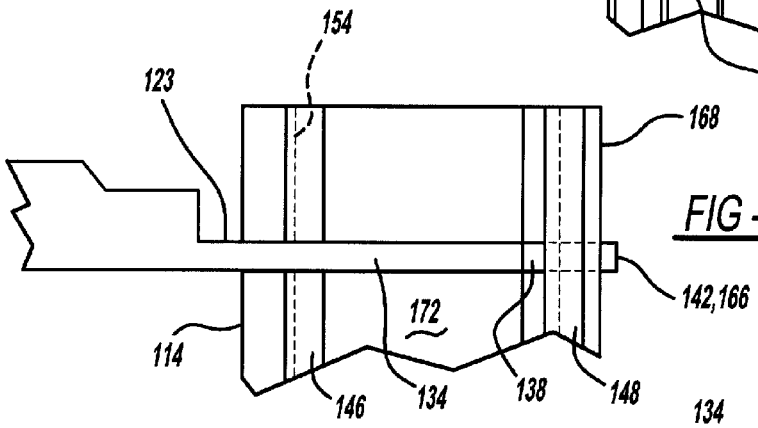
FIG. 7 is a top view of an embodiment of the teachings of the present disclosure.

FIG. 7 depicts how end surface 166 of end tab 142 protrudes through a wall bounding hole 154 and past an outside surface 168 of right end tank 114. Moreover, FIG. 7 depicts how first step portion 134 and second step portion 138 completely cover or substantially cover hole 154 to block fluid and gaseous content within interior volume 172 of end tank 114 from escaping, even when under a pressure greater than atmospheric pressure.

Thus, heat exchanger assembly 118 may employ cantilever portion 178 of heat exchanger end tank 114. Cantilever portion 178 may itself define and surround part of an interior tank volume (i.e. hole) of heat exchanger end tank 114. A second portion of the heat exchanger end tank, such as that portion that defines surface 152, may together with the cantilever portion 178, define a slot 150. A flared end 124 of side plate 120 may reside within slot 150. Flared end 124 of side plate 120 may have a straight portion 123 having a first width, first step portion 134 having a second width that is wider than straight portion 123, a second step portion 138 having third width 140 that is wider than a width 136 of first step portion 134. Still yet, flared end 124 of side plate 120 may have tab 142 that protrudes in a longitudinal direction of side plate from second step portion 138. Tab 142 may be symmetrical about a longitudinal axis 180 of side plate 120.

Heat exchanger end tank 114 may define a second slot 164 or hole such that tab 142 resides in second slot 164 when flared end 124 of side plate 120 resides within first slot 150. Flared end 124 may cover an entire cross-sectional portion of a volume defined by end tank 114. That is, the area between edges of side plate 120 in the regions of first step portion 134 and second step portion 138 may cover elliptical hole 154.

Second slot 164 of heat exchanger end tank 114 may be an entirely separate and non-merged slot or hole that is present through a thickness of second flat wall 184, which may be parallel to a first flat wall 182 on an opposite side of end tank 114. Tab 142 may have a width that is less than non-flared or straight portion 123. Tab 142 may protrude from second step portion 138 and into the second slot 164 and through the second flat wall 184. Heat exchanger assembly may further have, such as on an exterior surface of end tank 114, first strengthening rib 146 and second straightening rib 148. First slot 150 is cut through first straightening rib 146 and surface 156 of second step portion 138 contacts second straightening rib 148 with tab 142 protruding through second flat wall and past or beyond surface 184. Internal volume of end tank 114 may be elliptical in cross-section with first step portion 134 and second step portion 138 completely covering elliptical cross-section 154. Tab 142 may be symmetrical about a longitudinal axis 180 of side plate 120 and longitudinal axis 180 of side plate 120 may be coincident with a minor axis of the cross-section of the internal volume.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A heat exchanger assembly comprising:

a first heat exchanger end tank having a first portion defining part of an interior volume of the first heat exchanger end tank, wherein the first heat exchanger end tank has a first straightening rib and a second straightening rib each protruding from a lateral surface of the first heat exchanger end tank along at least a partial length of the first heat exchanger end tank;

a second heat exchanger end tank; and a side plate extending in a longitudinal direction between the first heat exchanger end tank and the second heat exchanger end tank; wherein a first slot is defined by cutting through both the first portion and a part of the first straightening rib;

the side plate has a flared end residing within the first slot and having:

a straight portion extending between the first and second heat exchanger end tanks having a first width;

a first step portion having a second width that is wider than the first width of the straight portion; and a second step portion having a third width that is wider than the second width of the first step portion;

the second step portion is inserted through the first slot and contacts the second straightening rib, the second step portion protrudes beyond the lateral surface;

the first straightening rib and the second straightening rib protrude from the lateral surface of the first heat exchanger end tank in a direction perpendicular to the longitudinal direction of the side plate;

the first slot is defined in a part of the first straightening rib; and the second straightening rib has no slot.

2. The heat exchanger of claim 1, wherein the flared end covers an entire cross-sectional portion of a volume defined by the end tank.

3. The heat exchanger of claim 1, wherein the flared end of the side plate further comprises:

a tab that protrudes from the second step portion.

4. The heat exchanger of claim 3, wherein the tab is symmetrical about a longitudinal axis of the side plate.

5. The heat exchanger of claim 4, wherein the first heat exchanger end tank defines a second slot.

6. The heat exchanger of claim 5, wherein the tab resides in the second slot when the flared end of the side plate resides within the first slot.

7. A heat exchanger assembly comprising:

a first heat exchanger end tank having a cantilever portion defining part of an interior volume of the first heat exchanger end tank, wherein the first heat exchanger end tank has a first straightening rib and a second straightening rib each protruding from a lateral surface of the first heat exchanger end tank along at least a partial length of the first heat exchanger end tank;

a second heat exchanger end tank; and a side plate extending in a longitudinal direction between the first heat exchanger end tank and the second heat exchanger end tank; wherein a first slot is defined by cutting through both the cantilever portion and a part of the first straightening rib; and the side plate has a flared end residing within the first slot and having:

a straight portion extending between the first and second heat exchanger end tanks having a first width;

a first step portion having a second width that is wider than the first width of the straight portion; and a second step portion having a third width that is wider than the second width of the first step portion;

the second step portion is inserted through the first slot and contacts the second straightening rib;

the second step portion protrudes beyond the lateral surface;

the first straightening rib and the second straightening rib protrude from the lateral surface of the first heat exchanger end tank in a direction perpendicular to the longitudinal direction of the side plate;

the first slot is defined in a part of the first straightening rib; and the second straightening rib has no slot.

8. The heat exchanger of claim 7, wherein the flared end is symmetrical about a longitudinal axis of the side plate.

9. The heat exchanger of claim 8, wherein the first heat exchanger end tank defines a second slot.

10. The heat exchanger of claim 9, wherein the flared end resides in the second slot when the flared end of the side plate resides within the first slot.

11. The heat exchanger of claim 10, wherein the flared end covers an entire cross-sectional portion of a volume defined by the end tank.

12. A heat exchanger assembly comprising:

a first heat exchanger end tank defining a first flat wall, a second flat wall, an internal volume and a first slot through the first flat wall, the first heat exchanger end tank having a side portion defining part of the internal volume, wherein the first heat exchanger end tank has a first straightening rib and a second straightening rib each protruding from a lateral surface of the first heat exchanger end tank along at least a partial length of the first heat exchanger end tank;

a second heat exchanger end tank; and a side plate extending in a longitudinal direction between the first heat exchanger end tank and the second heat exchanger end tank, the side plate having an end that protrudes from the first flat wall and into the internal volume, wherein the end of the side plate completely covers a cross-section of the internal volume, wherein the first slot is defined by cutting through the first flat wall, the side portion and a part of the first straightening rib;

the side plate has a flared end residing within the first slot and having:

a straight portion extending between the first and second heat exchanger end tanks having a first width;

a first step portion having a second width that is wider than the first width of the straight portion, and a second step portion having a third width that is wider than the second width of the first step portion, the second step portion is inserted through the first slot and is contacted with the second straightening rib;

the second step portion protrudes beyond the lateral surface;

the first straightening rib and the second straightening rib protrude from the lateral surface of the first heat exchanger end tank in a direction perpendicular to the longitudinal direction of the side plate;

the first slot is defined in a part of the first straightening rib; and the second straightening rib has no slot.

13. The heat exchanger of claim 12, wherein the first heat exchanger end tank further defines a second slot through the second flat wall.

14. The heat exchanger assembly of claim 13, wherein the end of the side plate further comprises:

a tab having a width that is less wide than the straight portion, the tab protruding from the second step portion and into the second slot and through the second flat wall.

15. The heat exchanger assembly of claim 12, wherein the internal volume is elliptical in cross-section and the first step portion and the second step portion completely cover the elliptical cross-section.

16. The heat exchanger assembly of claim 15, wherein the tab is symmetrical about a longitudinal axis of the side plate and the longitudinal axis of the side plate is coincident with a minor axis of the cross-section of the internal volume.

17. The heat exchanger of claim 7, wherein the flared end of the side plate further comprises:

a tab that protrudes from the second step portion.

18. The heat exchanger of claim 1, wherein the second step portion has a leading surface, which is perpendicular to the longitudinal direction of the side plate; and the leading surface abuts a rib surface of the second straightening rib.

19. The heat exchanger of claim 1, wherein the first step portion resides in the first slot.

20. The heat exchanger of claim 7, wherein the second step portion has a leading surface, which is perpendicular to the longitudinal direction of the side plate; and the leading surface abuts a rib surface of the second straightening rib.

21. The heat exchanger of claim 7, wherein the first step portion resides in the first slot.

22. The heat exchanger of claim 12, wherein the second step portion has a leading surface, which is perpendicular to the longitudinal direction of the side plate; and the leading surface abuts a rib surface of the second straightening rib.

23. The heat exchanger of claim 12, wherein the first step portion resides in the first slot.

* * * * *